US007448166B2

(12) United States Patent
Vantrease

(10) Patent No.: US 7,448,166 B2
(45) Date of Patent: Nov. 11, 2008

(54) CABLE GUIDE MECHANISM FOR LUGGAGE HANDLES

(75) Inventor: Steven Vantrease, Ann Arbor, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 631 days.

(21) Appl. No.: 11/057,580

(22) Filed: Feb. 14, 2005

(65) Prior Publication Data

US 2006/0179720 A1 Aug. 17, 2006

(51) Int. Cl.
*E05F 11/06* (2006.01)

(52) U.S. Cl. ..... 49/503; 296/146.4

(58) Field of Classification Search ..... 49/352, 49/503; 242/548, 615, 615.4; 296/1.02, 296/65.13, 76, 193.11, 146.4
See application file for complete search history.

(56) References Cited

U.S. PATENT DOCUMENTS 2,916,902 A * 12/1959 Wamsley ..... 70/93
4,878,391 A * 11/1989 Komatsu et al. ..... 74/89.2

FOREIGN PATENT DOCUMENTS

JP 6-53903 7/1994

* cited by examiner

*Primary Examiner*—Katherine W Mitchell
*Assistant Examiner*—Michael J Keller
(74) *Attorney, Agent, or Firm*—Gifford, Krass, Sprinkle, Anderson & Citkowski, P.C.

(57) ABSTRACT

A guide member for guiding a cable in an automotive vehicle, wherein the cable includes a handle having a grab portion and a stem supported at an end of the cable. The guide member includes a fastener, a guide portion and an end portion. The fastener is operative for fixedly securing said guide member to the vehicle. The fastener is integrally formed with the guide portion. The guide portion has a curved surface guiding the cable thereabout. Flanges extend from opposite sides of the curved surface. A retaining wall extends between the flanges. The retaining wall is spaced from the curved surface for retaining the cable therebetween.

19 Claims, 2 Drawing Sheets

CABLE GUIDE MECHANISM FOR LUGGAGE HANDLES

BACKGROUND OF THE INVENTION

1. Field of the Invention

The invention relates to a cable guide mechanism handle actuated cables in an automotive vehicle. More particularly, the invention relates to a cable guide mechanism that acts as a combined guide for a cable and support for a handle.

2. Description of the Related Art

Mechanisms actuated by a cable are commonly utilized throughout an automotive vehicle. Examples of such cable actuated mechanisms include vehicle seating, hood or bonnet latches, door locks and the like. Often it becomes necessary to route the cable along a tight turning radius, which potentially causes a kinking of the cable, or otherwise causes a malfunction of the cable and the mechanism actuated by the cable. Further, it is often the case that the cable must be routed along a tight turn in immediate proximity of a luggage or release handle.

Japanese Model Application Publication Number SHO 63-59063 (the '063 reference) provides a housing for a stick-type parking brake lever. Typically, a stick-type parking brake lever mechanically actuates the brakes of a vehicle via a cable. The housing of the '062 reference uses a pulley wheel for guiding the cable. The housing also provides a passage or clearance for movement of the handle therein. The housing provided by the '062 reference does not, however, provide a means for guiding a cable routed along a side wall of a vehicle and for supporting a handle, such as a latch release handle, secured to an end of the cable. Further, the use of a pulley wheel is a relatively expensive means of routing a cable used for light duty use, such as a door or seat latch release mechanism.

Accordingly, it remains desirable to provide a cost effective cable guide that serves both functions of guiding a cable about a tight turning radius and supporting a release handle secured to an end of the cable.

SUMMARY OF THE INVENTION

According to one embodiment, a guide member is provided for guiding a cable in an automotive vehicle, wherein the cable has an end and a handle fixedly secured thereto. The guide member includes a housing having: a wall defining a passage for receiving a portion of the handle therein, wherein the passage has an inner end; a curved surface guiding the cable thereabout, wherein the curved surface extends to the inner end; and a fastener having a boss and a leg. The boss extends from the housing. The leg extends from an end of the boss. The leg elastically deforms to a position aligned along the boss allowing insertion of the fastener through an aperture in a wall of the vehicle. The said leg is biased to a locking position retaining the fastener within the aperture.

According to one embodiment, a guide member is provided for guiding a cable in an automotive vehicle, wherein the cable has an end and a handle fixedly secured thereto. The guide member includes a housing having: a fastener fixedly securing the guide member to a wall of the vehicle; a wall defining a passage for receiving a portion of the handle therein, the passage having an inner end; a curved surface for guiding the cable thereabout, wherein the curved surface extends to the inner end; a pair of flanges extending outwardly from the curved surface; and a retainer wall extending between the flanges, the retainer wall being spaced apart from the curved surface to form a generally closed cross section through which the cable is routed.

BRIEF DESCRIPTION OF THE DRAWINGS

Advantages of the present invention will be readily appreciated as the same becomes better understood by reference to the following detailed description when considered in connection with the accompanying drawings, wherein.

DETAILED DESCRIPTION OF THE INVENTION

The invention provides a guide member for guiding a cable in an automotive vehicle, wherein the cable has an end and a handle fixedly secured thereto. Described in greater detail below, the guide member includes a fastener allowing assembly of the guide member to a wall of the vehicle. The guide member is also adapted for supporting the handle in a non-actuated position, wherein the handle is readily accessible by a user.

Figure 1:
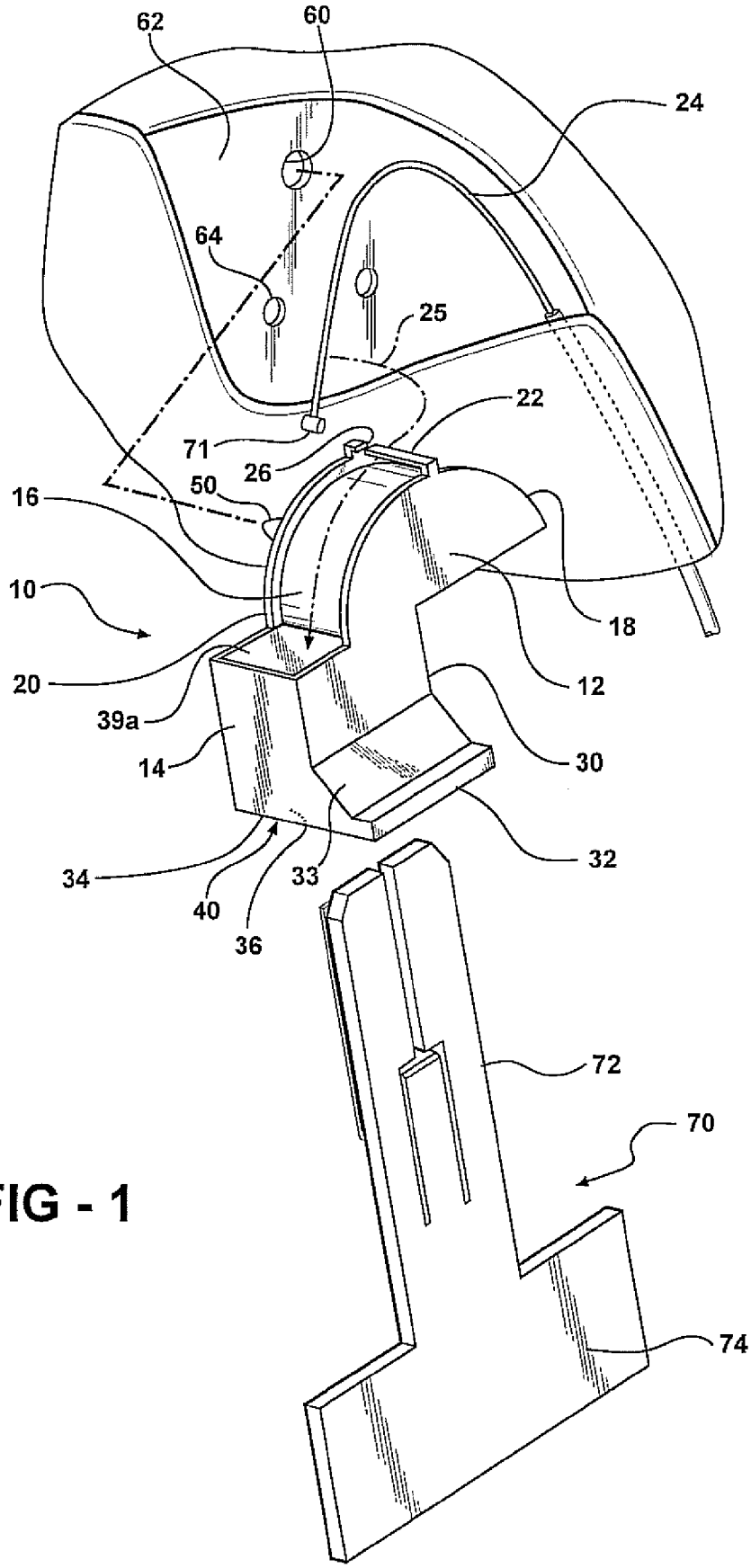
FIG. 1 is a perspective view of a cable guide according to the invention.
Figure 2:
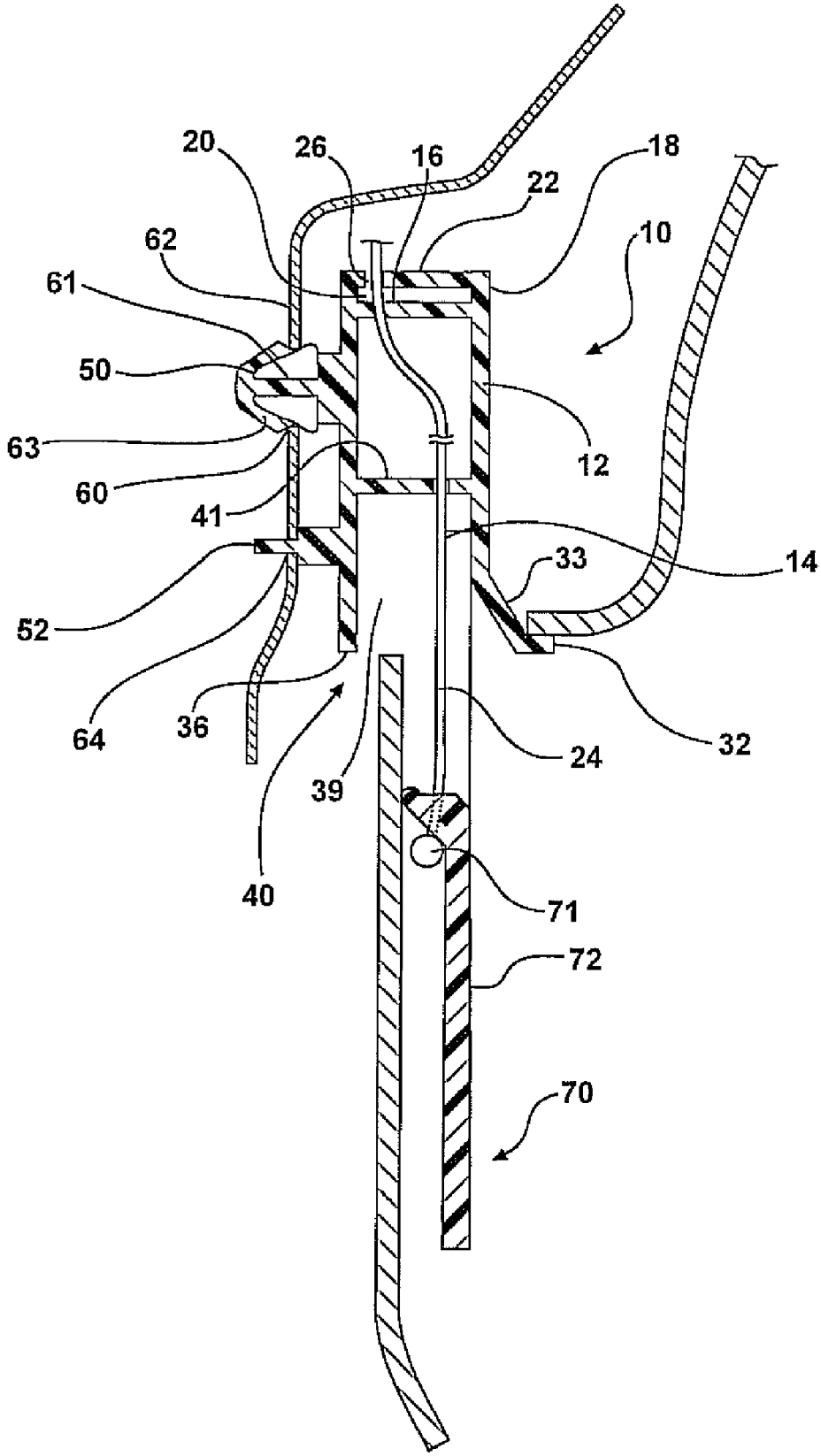
FIG. 2 is a cross sectional view of the cable guide.

Referring to FIGS. 1 and 2, a guide member according to an embodiment of the invention is generally indicated at 10. The guide member 10 includes a guide portion 12 and an end portion 14. The guide portion 12 includes a curved surface 16, preferably having a substantially U-shaped cross section defined by downwardly extending legs and a curved portion extending therebetween. Flanges 18, 20 extend outwardly along opposite sides of the curved surface 16. The flanges 18, 20 are generally parallel and spaced transversely apart from each other. A retainer wall 22 is spaced from the curved surface 16 and extends between ends of the flanges 18, 20. As best shown in FIG. 2, the curved surface 16, the retainer wall 22 and the flanges 18, 20 define a generally rectilinear cross section through which a cable 24 is routed. Optionally, a slot 26 is defined in the retainer wall 22 facilitating insertion of the cable 24 between the retainer wall 22 and the curved surface 16.

The end portion 14 includes at least one wall defining a passage 39 for receiving a portion of the handle therein. In the embodiment shown in the figures, the end portion 14 includes four walls 30, 32, 34, 36 arranged to define a passage 39 and opening 40 having a rectilinear cross section as identified in FIG. 2 and further evident from the configuration of the end portion 14 in FIG. 2. It should be appreciated by those of ordinary skill in the art that the passage and opening can be defined by any number of walls to form a cross section having any shape, such as a continuous wall defining an opening having a circular cross section.

The passage 39 extends longitudinally between tile opening 40 and an inner end 39*a*. The inner end 39*a* is disposed adjacent the curved surface 16 (see FIG. 1). An abutment wall 41 is defined at the inner end 39*a* of the passage 39. The abutment wall 41 (see FIG. 2) engages and maintains the handle in a nonactuated position, wherein a portion of the handle as is shown at 70 is readily accessible by a user. Preferably, the curved surface 16 guides the cable 24 to a central portion of the passage 39 (see arrow 25 in FIG. 1).

In typical use, the opening 40 of the end portion 14 will be in communication with or extend through a corresponding aperture in a trim panel of a vehicle interior. Accordingly, a lip 33 extends outwardly from the end portion 14 along at least a portion of the opening 40 to conceal the aperture in the trim panel.

A fastener 50 is integrally formed with the guide member 12. The fastener 50 allows the guide member 10 to be fixedly secured to the vehicle. It should be appreciated that the guide member 10 can, however, be fixedly secured to the vehicle using any suitable fixing means known by those of ordinary skill in the art, such as screws, barb fasteners and the like. Preferably, a locator pin 52 (see FIG. 2) extends outwardly from the guide member 10.

In use, the fastener 50 is hookingly engaged through a corresponding aperture 60 in a sheet metal wall 62 of the vehicle. More specifically, the fastener has a boss 61 and a leg 63 extending from an end of the boss 61. The leg 63 elastically deforms to a position aligned along the boss 61 allowing insertion of the fastener 50 through the aperture 60 in the wall 62 of the vehicle and, thereafter, returns to a locking position extending generally acutely from the end of the boss 61. That is, after passing from one side of the wall 62 through the aperture 60, the leg 63 returns to the acutely extending position to hookingly engage the opposite side of the wall 62. At the same time, the locator pin 52 extends through another aperture 64 in the wall 62 preventing rotation of the guide member 10 about the fastener 50. From the wall 62, the cable 24 is routed about the curved surface 16 of the guide member 10 see again arrow 25. It should be appreciated that the curved surface 16 has a sufficiently large radius to minimize kinking of the cable 24. The cable 24 then passes between the retainer wall 22 and the curved surface 16 and downwardly through the inner end 39*a* of the opening 40 of an end portion 14.

The handle 70 includes a stem 72 fixedly secured to the end of the cable 24. In a ready nonactuated position, a grab portion 74 (see FIG. 1) of the handle 70 is presented below the opening 40 in the end portion 14, where it can be grabbed and pulled by a user. The handle 70 hangs at the end of the cable 24, so that in the ready position, the stem 72 is supported between the walls 30, 32, 34, 36 that define the opening 40. Further, the stem 72 is located below and approximate the abutment wall 41 maintaining the handle 70 in the nonactuated position. In conventional guide designs, the handle 70 dangles unsupported by the end of the cable 24. Thus, in this regard, the guide member 10 of the present invention provides an appreciable advantage over conventional cable and guide arrangements.

Any suitable injection moldable material can be used, which provides sufficient rigidity to support loads associated with actuation of the cable 24. The material chosen should also have sufficient hardness and frictional characteristics so as to minimize drag during actuation of the cable due to friction between the cable and the curved surface 16. For example, the guide member 10 can be injection molded from glass reinforced nylon, polypropylene or ABS plastics.

The invention has been described in an illustrative manner. It is, therefore, to be understood that the terminology used is intended to be in the nature of words of description rather than of limitation. Many modifications and variations of the invention are possible in light of the above teachings. Thus, within the scope of the appended claims, the invention may be practiced other than as specifically described.

The invention claimed is:

1. A guide member for guiding a cable in an automotive vehicle, the cable having an end and a handle fixedly secured thereto, said guide member comprising:

a housing having:

a wall defining a passage for receiving a portion of the handle therein, said passage having an inner end;

a curved surface for guiding the cable thereabout, the curved surface extending to said inner end; and a fastener having a boss and a leg, said boss extending from said housing, said leg extending from an end of said boss, said leg elastically deforming to a position aligned along said boss allowing insertion of said fastener through an aperture in a wall of the vehicle, said leg being biased to a locking position retaining said fastener within said aperture.

2. A guide member as set forth in claim 1 including a pair of flanges extending outwardly from the curved surface, said flanges being spaced apart from each other retaining the cable therebetween.

3. A guide member as set forth in claim 2 including a retainer wall extending between said flanges, said retainer wall spaced apart from said curved surface to form a generally closed cross section through which the cable is routed.

4. A guide member as set forth in claim 3, wherein said curved surface, said retainer wall and said flanges define a rectilinear cross section through which the cable is routed.

5. A guide member as set forth in claim 3, wherein said retainer wall includes a slot formed therein facilitating insertion of the cable between said retainer wall and said curved surface.

6. A guide member as set forth in claim 1, wherein said curved surface is defined by a substantially U-shaped cross section.

7. A guide member as set forth in claim 1, wherein said housing defines an opening through which die handle protrudes outwardly from said passage of said housing.

8. A guide member as set forth in claim 1 including a lip extending outwardly from said housing along said opening.

9. A guide member as set forth in claim 8 wherein said housing includes an abutment wall positioned at said inner end of said passage, said abutment wall engages the handle and maintains the handle in a non-actuated position within said passage of said housing.

10. A guide member as set forth in claim 1 including a locator pin that engages the vehicle body and prevents rotation of said guide member about said fastener while engaged with the aperture in the side wall.

11. A guide member as set forth in claim 1, said guide member further comprising a guide portion and an end portion, wherein said fastener is integrally formed with said guide portion.

12. A guide member as set forth in claim 11, wherein said fastener, said guide portion and said end portion are integrally formed together from plastic in a molding process.

13. A guide member as set forth in claim 12 formed from glass reinforced plastic in an injection molding process.

14. A guide member for guiding a cable in an automotive vehicle, the cable having an end and a handle fixedly secured thereto, said handle having two edges spaced apart a predetermined width, said guide member comprising:

a fastener securing said guide member to a wall of the vehicle;

two walls spaced apart a predetermined distance greater than said predetermined width to define a passage for receiving a portion of the handle therein, said passage having an inner end, said two walls being immovable with respect to the wall of the vehicle;

a curved surface for guiding the cable thereabout, said curved surface extending from said inner end, said curved surface being immovable with respect to the wall of the vehicle; and a pair of flanges extending outwardly from said curved surface.

15. A guide member as set forth in claim 14, wherein a retainer wall extends between said flanges and is spaced from said curved surface, said retainer wall and said flanges define a rectilinear cross section through which the cable is routed.

16. A guide member as set forth in claim 15, wherein said retainer wall includes a slot formed therein facilitating insertion of die cable between said retainer wall and said curved surface.

17. A guide member as set forth in claim 16, wherein said curved surface is defined by a substantially U-shaped cross section.

18. A guide member as set forth in claim 17, wherein a housing established by said guide member defines an opening through which the handle protrudes outwardly from when communicating with said passage of said housing.

19. A guide member as set forth in claim 14, wherein said fastener includes a boss and a leg, said boss extending from said housing, said leg elastically deforming to a position aligned along said boss allowing insertion of said fastener through an aperture in a wall of the vehicle, said leg being biased to a locking position retaining said fastener within said aperture.

* * * * *

UNITED STATES PATENT AND TRADEMARK OFFICE

CERTIFICATE OF CORRECTION

PATENT NO. : 7,448,166 B2
APPLICATION NO. : 11/057580
DATED : November 11, 2008
INVENTOR(S) : Steven Vantrease It is certified that error appears in the above-identified patent and that said Letters Patent is hereby corrected as shown below:

Column 2, line 53, replace “tile” with --the-

Column 4, line 27, replace “die” with --the--

Column 5, line 5, replace “die” with --the--

Signed and Sealed this

Twenty-fourth Day of March, 2009

John Doll

JOHN DOLL
*Acting Director of the United States Patent and Trademark Office*